US005716182A

United States Patent [19]

Leu

[11] Patent Number: 5,716,182

[45] Date of Patent: Feb. 10, 1998

[54] METHOD AND APPARATUS FOR CONNECTING THE SHEETS OF A MULTI-SHEET PRINTED PRODUCT

[75] Inventor: Willy Leu, Pfäffikon, Switzerland

[73] Assignee: FERAG AG, Switzerland

[21] Appl. No.: 576,963

[22] Filed: Dec. 22, 1995

Related U.S. Application Data

[63] Continuation of Ser. No. 258,096, Jun. 10, 1994, abandoned.

[30] Foreign Application Priority Data

Jun. 11, 1993 [CH] Switzerland ..... 01 754/93

[51] Int. Cl.[6] ..... B42C 9/00

[52] U.S. Cl. ..... 412/8; 412/37; 156/252; 156/253; 156/256; 156/513; 156/515; 408/1 R; 408/61

[58] Field of Search ..... 412/8, 32, 33, 412/37; 156/250, 251, 252, 253, 515, 256, 513; 408/1 R, 53, 61

[56] References Cited

U.S. PATENT DOCUMENTS

| | | | |
|---|---|---|---|
| 3,993,523 | 11/1976 | Hunt et al. | 156/253 X |
| 5,137,409 | 8/1992 | Honegger | 412/8 |
| 5,193,851 | 3/1993 | Honegger | 281/15.1 |
| 5,213,647 | 5/1993 | Chapron et al. | 156/253 X |
| 5,221,163 | 6/1993 | Nishimura | 408/230 X |
| 5,333,973 | 8/1994 | Hoshino et al. | 408/56 |
| 5,368,419 | 11/1994 | Imus | 408/137 X |

FOREIGN PATENT DOCUMENTS

| | | | |
|---|---|---|---|
| 0 390 733 | 3/1989 | European Pat. Off. . | |
| 0 390 734 | 3/1990 | European Pat. Off. . | |
| 1 355 132 | 5/1974 | United Kingdom . | |
| 2106033 | 4/1983 | United Kingdom | 412/8 |
| 7900839 | 10/1979 | WIPO | 412/37 |

OTHER PUBLICATIONS

Xerox Disclosure Journal "Binding Apparatus" Acquauiva, Thomas, vol. 1, No. 1, Jan. 1976 p. 1.

*Primary Examiner*—S. Thomas Hughes
*Attorney, Agent, or Firm*—Brinks Hofer Gilson & Lione

[57] ABSTRACT

For the connection of the sheets of a multi-sheet printed product (14), such as magazines, brochures and the like, the sheets are adhesively connected together point-wise by the introduction of an adhesive into perforations formed in them. During this, the adhesive applied to the outer side of the penetration and drilling needles (20) is transferred onto the sheets over the whole length of the perforations simultaneously with the formation of the perforations by means of these needles (20) and/or on retraction of the needles (20).

41 Claims, 5 Drawing Sheets

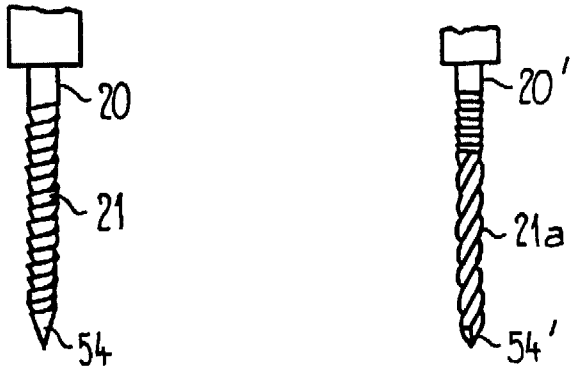
Fig. 4A
Fig. 4B
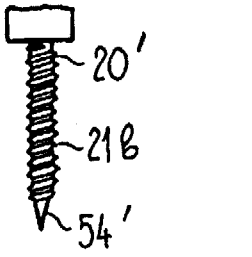
Fig. 4C
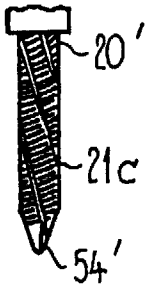
Fig. 4D
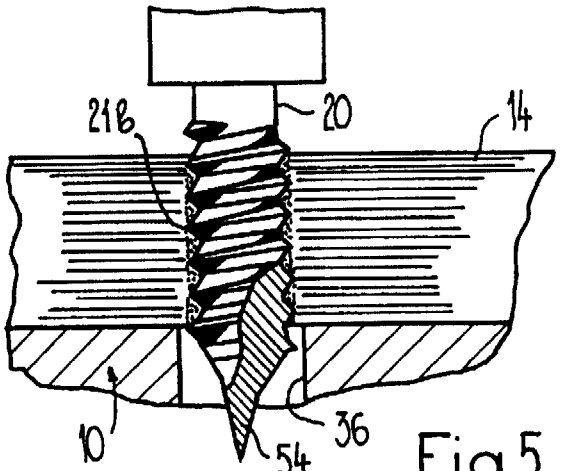
Fig. 5
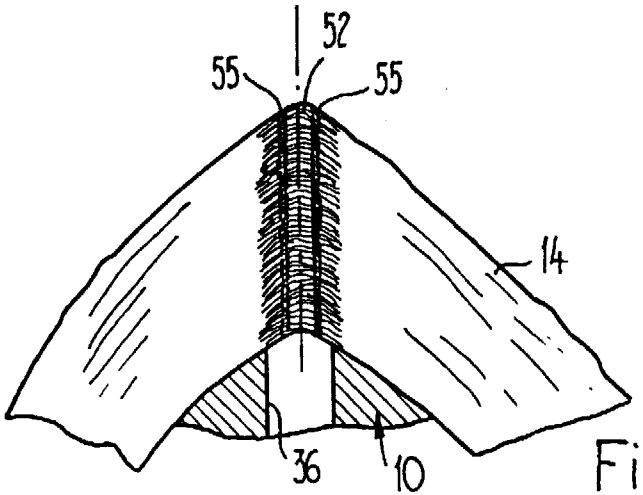
Fig. 6

METHOD AND APPARATUS FOR CONNECTING THE SHEETS OF A MULTI-SHEET PRINTED PRODUCT

This application is a continuation of application Ser. No. 08/258,096, filed Jun. 10, 1994, now abandoned.

The present invention relates to a method for connecting the sheets of a multi-sheet printed product, such as magazines, brochures and the like, in which the sheets are adhesively connected together point-wise by the introduction of an adhesive into perforations formed in them, and also to an apparatus for carrying out this method.

BACKGROUND OF THE INVENTION

A method or an apparatus of the kind named above is known from EP-A-0390734.

In this known method, as also in the present method, the aim is to glue together the sheets or pages of magazines, brochures, pocket books and the like point-wise in the region of the spine instead of keeping them together with staples. It would be desirable to have this glue method and keep the advantages of known wire or staple fastening methods, such as for example the ability to fully open the product without a notable loss of the area available for printing adjacent the folded edge, (i.e. a marginal region along which the sheets are inseparably connected together is to be avoided). A marginal region of this kind exists, for example, with the adhesive method disclosed in prior art DE-A-2126495. In the arrangement disclosed in this reference one first produces holes in the marginal regions of the sheets and then fills these holes with a curable adhesive, so that a type of riveted connection with enlarged head and foot ends arises between the individual sheets.

In another prior art arrangement disclosed in EP-A-0390734, which likewise originates from the present applicants, the point-wise adhesive connection take place at a row of adhesive positions. These adhesive positions are arranged along a line which later forms the fold line of the respective product. The injection of the bonding agent takes place in this arrangement either after a pre-perforation of the paper layers and the application of the bonding means by hollow needles or canulas, or by direct droplet injection into the paper layers.

In an embodiment which is shown in FIG. 3 of EP-A-0390734 the perforation and the injection of the bonding medium can be executed in the same working step depending on the nature of the paper layers. This is possible when the bonding medium injection can be effected directly during the perforation by hollow needles or canulas. Although this procedure has its advantages, there are some problems which preferably would be avoided.

One problem lies in the fact that the hollow needles can become blocked at the hollow working tips. Indeed, the hollow needles may be blocked by small particles of paper which are punched out from the paper during penetration by the hollow needles. The hollow needles can also be blocked relatively easily by adhesive residues, since the central passage must be made relatively long in relation to its cross-section. It is also possible that adhesive pushed out of the hollow needles does not penetrate into the individual paper sheets to an adequate degree during further movement of the hollow needles (i.e. the adhesive does not adequately wet the paper sheets). Thus, adhesive connection may not always be ensured for a broad spectrum of different paper thicknesses and qualities or types. The higher the working speed, the more critical the problem. The hollow needles are also exposed to relatively pronounced wear when one takes account of the number of perforations which are to be made at high working speed.

Finally, the use of hollow needles leads holes which are relatively large, particularly if blocking and wear are to be reduced. This is undesirable since the puncture locations should remain inconspicuous in the finished magazine.

PRINCIPAL OBJECT OF THE INVENTION

An object of the present invention is to provide a method or an apparatus which operates with needles or the like as penetration tools, but which ensures reliable adhesive bonding between the individual sheets without the problems of blockage, and operates at a high working speed with an increased working life of the tool (i.e. with reduction of the susceptibility to wear and for relatively small dimensions of the perforations that are produced).

SUMMARY OF THE INVENTION

In order to satisfy this object, the present invention proposes a method wherein the adhesive is located on the outer side of a perforation tool and is simultaneously transferred onto sheets over the whole length of the perforations by means of a perforation tool during at least one of the penetration and extraction movements of the perforation tool relative to the sheets.

Also in accordance with the present invention there is provided an apparatus for connecting the sheets of a multi-sheet printed product, such as magazines, brochures or the like. The sheets, which are supported on a support, are perforated by means of perforating tools and adhesive is introduced into the so formed perforations. The penetration tool has a plurality of needles, each having a closed tip, with pick-up means, which receive the adhesive being provided at their outer side for transfer of the adhesive to the walls of the perforations.

Since the adhesive is located at the outside of the perforation tool, it is brought by the driving-in or extraction movement of this tool into intimate contact with the inner surface of the perforation which is simultaneously formed in one working step. Thus, a complete and uniform wetting of the sheets of stacked paper with adhesive is achieved. Since the perforation tool is pointed at its tip, the perforations are generated by lateral displacement of the paper material of the sheets. Thus, punched out paper particles no longer arise, and thus avoiding blockages. The pointed tapering ends of the tools also lead to reduced wear of the latter, so that they last longer. Since the adhesive is present on the tools at the outside, it serves as a type of lubricant, thus also helping to reduce wear. It is also possible to make the passages or perforations smaller than is possible with hollow needles, i.e. the adhesive connection remains inconspicuous. Since the displaced paper material has the tendency to return after removal of the tools, the diameter of the passages is finally also smaller than the outer diameter of the penetration tools.

In the method of the invention it is possible, as in the arrangement disclosed in EP-A-0390734, to perform the adhesive bonding through a stack of sheets which is subsequently supplemented by a cover sheet and by a central sheet and only then is fully folded together. In this way, no perforations can be seen in the cover sheet and in the central sheet. The previously introduced adhesive is sufficient to also adhesively bond the cover sheet and the central sheet with the perforated sheets in the fold, particularly as a result of the squeezing action associated with folding.

Since the penetration and the introduction of the adhesive takes place during the same to and fro movement of the penetration tool relative to the stack of sheets, the working time is kept short. Thus, the throughput achievable with the invention can be kept high.

The nature of the bonding of the sheets in accordance with the invention makes it possible to separate part of the sheets without the printed product falling apart.

The transfer of the adhesive onto the sheets preferably takes place during a screwing-in or screwing-out movement of penetration tools which are formed in needle-like manner. Although a pure linear movement of the tool could be sufficient to generate the passages or perforations, a rotational movement of the tools is also used in a preferred embodiment, at least during the driving-in or extraction of the latter. In this way the adhesive is scraped off from the tools and is brought into intimate contact with the paper sheets around the perforations. This results in a high quality adhesive bond. The perforations are thus preferably generated with rotatable penetration or drilling needles.

In a more preferred embodiment, the transfer of the adhesive takes place using penetration or drilling needles having a screw thread-like shape.

Preferably, the driving-in speed or extraction speed and the speed of rotation of the penetration or drilling needles is selected so that it is matched to the screw thread pitch. The thread shape of the needles generates a corresponding thread-like deformation of the paper material with an enlarged surface compared to a smooth cylindrical surface of comparable diameter. This serves to improve the quality of the adhesive bond.

It is also possible to select the driving-in speed or speed of extraction and the speed of rotation of the penetration or drilling needles independently of the thread pitch, i.e. not matched to the latter. This leads to a certain scraping action between the needles and the paper and to a certain jamming effect which presses the adhesive deeper into the paper material. This design thus also leads to higher quality adhesive connections.

It is also possible to select the driving-in speed differently from the extraction speed. This permits the movement which is principally responsible for the adhesive transfer to be performed somewhat more slowly in exchange of performing the other phase of the movement somewhat faster. The result is that for comparable cycle times higher quality connections can be generated.

It is also possible to vary the rotational speed during the driving-in and/or the extraction of the tools. In this way one can attempt to obtain certain fine matching and an intentional distribution of the adhesive. For example the matching can be such that more adhesive is present in the region of the upper and lower sheets of the stack. This is useful for the subsequent connection of the covering sheet and of the central sheet respectively.

In a preferred embodiment, the adhesive is applied to the penetration or drilling needles directly prior to the driving-in of the latter, however, it is also possible to first apply the adhesive to the penetrating or drilling needles when they have penetrated the stack of sheets.

BRIEF DESCRIPTION OF THE DRAWINGS

The invention will now be explained in more detail with reference to the following drawings and with reference to preferred embodiments.

FIGS. 4A to 4D show side views of four different embodiments of the penetration needles.

FIG. 5 shows a detailed drawing of a penetration needle during the manufacture of an adhesive bond between several sheets laid on top of one another.

FIG. 6 shows a schematic illustration of the adhesive bond between several sheets laid on top of one another after the extraction of the penetration needles.

DETAILED DESCRIPTION OF THE PRESENTLY PREFERRED EMBODIMENTS

Figure 1:
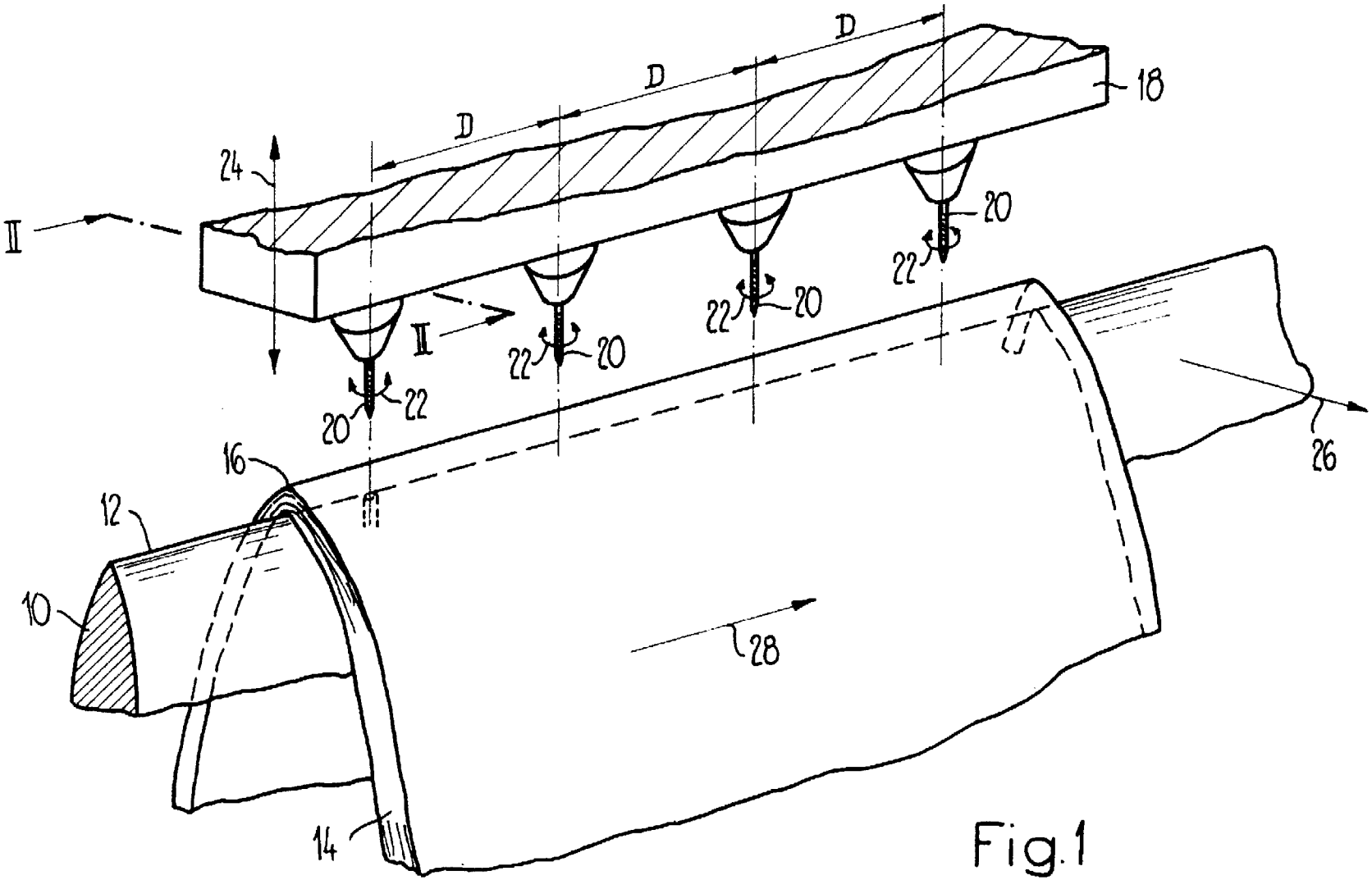
FIG. 1 shows a perspective illustration of a procedure for the connection, in the area of the fold line, of the sheets of a magazine which are laid on top of one another.

FIG. 1 shows an elongated support or transport element 10 with a support edge 12 and several prefolded paper sheets 14 which are laid on top of one another. The paper sheets 14 are disposed over the support element 10 such that their fold line 16 lies on the edge 12. A carrier beam 18 is located above the support or transport element 10 and carries several penetration tools. The penetration tools are in the form of penetration or drive-in needles 20 which are arranged with a mutual spacing D.

The penetration needles 20 are rotatably arranged and can be rotated in both directions of rotation as is indicated by the double arrow 22. The rotational drive is in practice arranged within the carrier beam 18 which is formed as a hollow beam. The carrier beam 18 can be moved downwardly as shown with the double arrow 24 in order to press the penetration needles 20 through the sheets lying on top of one another and can be raised again in order to extract the penetration needles from the paper sheets.

As is indicated by the arrow 26, the transport element 10 can move past the carrier beam 18 and can stop in the position shown in FIG. 1 for the driving-in and the extraction of the penetration needles. As an alternative to this the carrier beam 18 can likewise be moved in the direction of arrow 26 with the same speed as the transport member 10. The beam 18 can also, for example, be subsequently moved back again in order to drive the penetration needles 20 through a following sheet stack 14 on a further transport beam 10.

It is also possible to displace the individual sheet stacks stepwise in the direction of the arrow 28 along the support element 10. In this manner, for each step a new sheet stack is aligned, as shown in FIG. 1, beneath the carrier beam 18. The new sheet stack can then be processed by the penetration needles 20 by lowering of the carrier beam 18 and subsequent lifting of the carrier beam 18. It should be noted that the number of the penetration needles 20 is not restricted to four, but rather the number of the penetration needles can be selected as desired.

The precise drive-in process will be explained in the following in more detail with reference to FIGS. 2A to D. These sectional drawings show the formation of the support or transport element 10. These drawings also show two further components, that is a press means 30 adhesive supply means 32. The press means functions as a product pressing means and centering means and can be made in accordance with the carrying beam 18 as an elongate beam. The adhesive supply means 32 can be moved to and fro as shown with the double arrow 34.

Figure 2A:
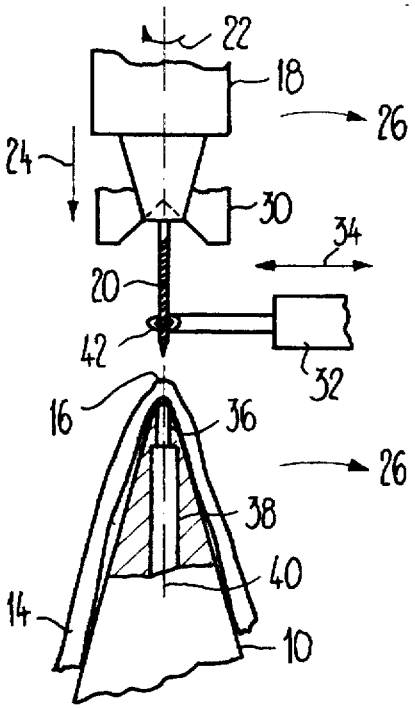
FIGS. 2A to 2D show sectional drawings of the section plane II—II in FIG. 1 showing various stages of the manufacture of a connection between the sheets.

As can be seen from FIG. 2A a bore 36 is located directly beneath each needle 20 in the region of the support edge 12 of the support element 10. The bore 36 has a diameter which is somewhat larger than the diameter of the respective penetration needle and which merges into a larger bore 38. The longitudinal axis of the needle 20 is aligned with the longitudinal axis 40 of the bore 36 and of the bore 38 coaxial thereto.

Figure 2B:
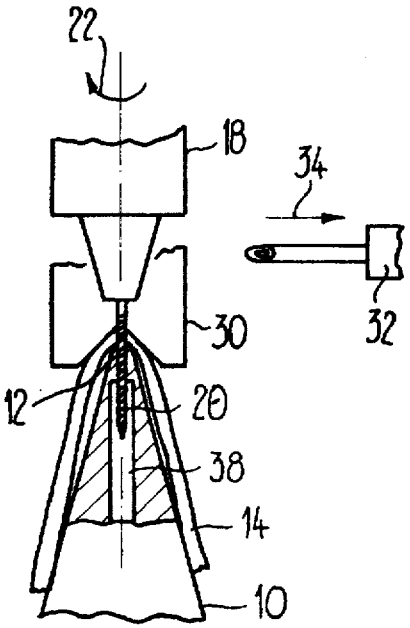
Figure 2C:
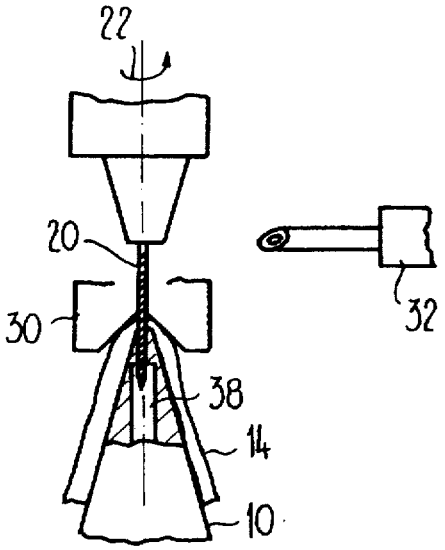

In the stage of FIG. 2A the holding beam 18 is moved downwardly as illustrated with the arrow 24 and the adhesive supply means 32 is located in its left hand end position. In this left hand end position, the adhesive is dispensed in a metered quantity from a nozzle 42 onto the penetration needle 20 which is rotating as illustrated with the arrow 22. An adequate length of the penetration needle 20 is coated with adhesive in order to transfer the adhesive in an adequate amount to the individual sheets of the stack during the pushing of the penetration needle 20 through the sheet stack 14. After the dispensing of the adhesive onto the penetration needle 20, the adhesive supply means 32 is moved to the right out of the region of the beam 18. Here, it adopts the other end position as shown in FIG. 2B. The pressing means 30 is pressed towards the edge 12 of the support or transport element 10 onto the sheet stack 14. The carrier beam 18 is subsequently moved downwardly as illustrated with the arrow 24 with simultaneous rotation of the penetration needles 20 in the direction of arrow 22. The penetration needles 20 thus penetrate through the sheet stack and are partly received in the bores 36 and 38. The direction of rotation of the penetration needles 20 is then reversed, as shown in FIG. 2C. The carrier beam 18 is lifted, so that the penetration needle 20 is drawn out of the sheet stack 14. The press means 30 remain down during this process and continues to exert pressure on the sheet stack. This prevents tearing the upper sheets during the retraction of the needles 20.

Figure 2D:
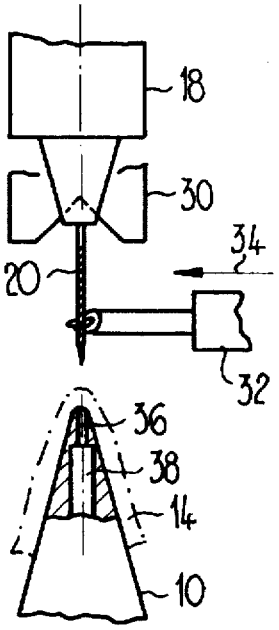

After the needles are completely extracted, the adhesive supply means 32 is subsequently moved from the right-hand waiting position shown in FIGS. 2B and 2C to the left into the position shown in FIG. 2D, thereby returning to the initial position of FIG. 2A. A following support element 10 with a new sheet stack 14 is then brought into alignment with the carrier beam 18. Alternatively, a new sheet stack 14 is displaced along the support element 10 until this next stack is aligned with the carrier beam 18. The working cycle can then be repeated.

In the embodiment of FIGS. 1 and 2 the adhesive is introduced with the penetration needles 20 from the same side as the needles 20 are driven in. The needles 20 are so shaped, or the retraction of the needles takes place in such a way, that on retraction of the needles 20 they do not cause the adhesive to move out of the perforations formed by the penetration procedure to any notable degree. This is ensured by the combined rotation and linear displacement possibilities during the driving-in and extraction of the penetration needles. This will subsequently be explained in more detail with reference to FIGS. 4, 5, 6 and 7.

In another embodiment, the perforations are first formed by driving in the penetration needles 20 and the adhesive is then applied to the needles 20 and transferred onto the paper sheets upon retraction of the needles 20 through the previously produced through-openings. In this embodiment, the adhesive is supplied at the inner side of the fold line 16, as shown in FIGS. 3A to 3D.

In these Figures a modification of the support 10 is first provided to support the sheet stack 14. In this embodiment, the support 10 has a planar support surface 44. On the lower side of the planar support surface there are provided channel or individual chambers 46. These individual chambers 46 serve as a reservoir for adhesive 48 and are connected to a supply hose 50. Beneath each needle 20 there is also located a bore 36. This makes it possible to drive the needles 20 in accordance with FIG. 3B through the sheet stack 14 and the bore 36' into the quantity of adhesive 48. With this arrangement, the lower end of the penetration needle 20 is coated with adhesive which is transferred onto the individual sheets of the sheet stack 14 during the extraction movement.

The design of the carrier beam 18 and also of the pressing means 30 in this example corresponds to the design of the same components in the embodiment of FIGS. 1 and 2, except that in practice the layout of the pressing means 30 is matched to the flat position of the sheet stack 14. In FIG. 3 the pressing means 30 is, however, shown for the sake of simplicity in precisely the same manner as in FIG. 2. Chambers or channels filled with adhesive could however, basically be provided in accordance with FIGS. 3A to 3D precisely inside of the support element 10 of the embodiments of FIGS. 1 and 2.

Figure 3A:
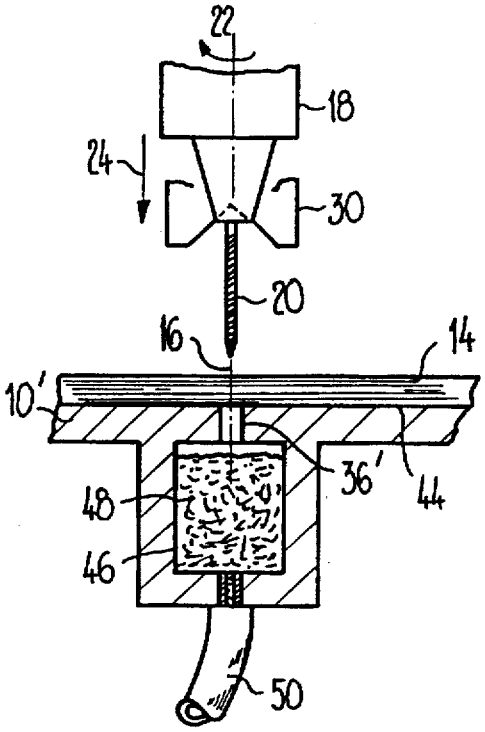
FIGS. 3A to 3D show sectional drawings similar to the sectional drawings of FIGS. 2A–2D, but of a modified embodiment.
Figure 3B:
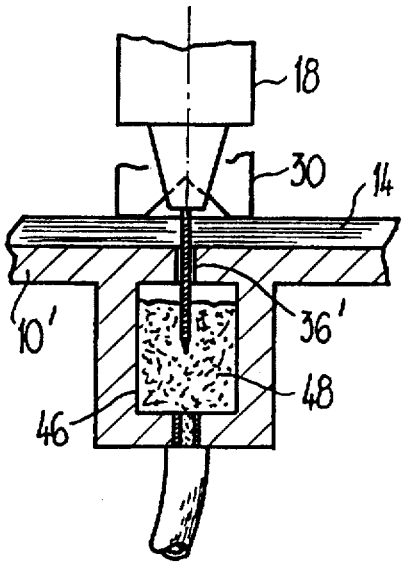
Figure 3C:
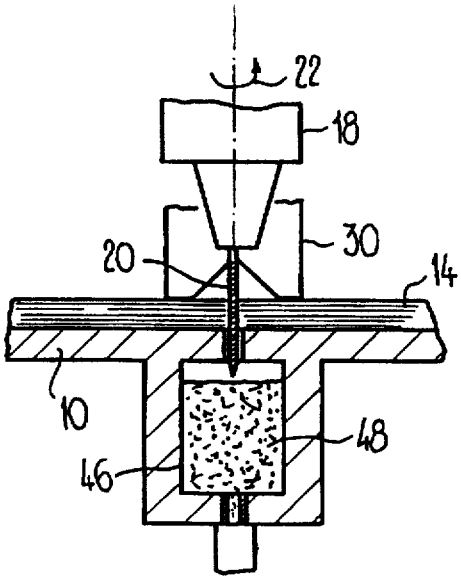
Figure 3D:
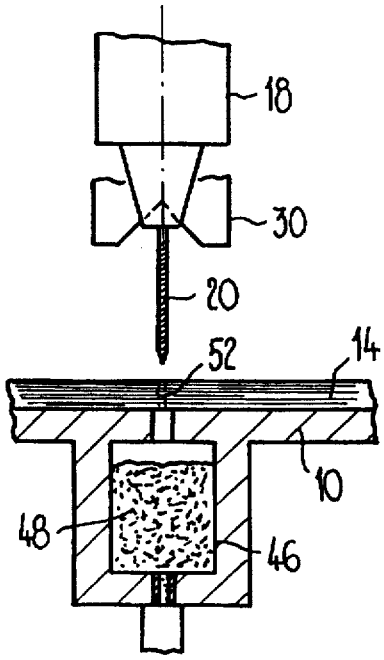

After the dipping of the tips of the penetration needles 20 into the adhesive in accordance with FIGS. 3B, the carrier beam 18 is retracted via the intermediate position of FIG. 3C into the end position of FIG. 3D. Here the press means 30 is retracted into the position of FIG. 3D as previously disclosed only after complete removal of the penetration needles 20 from the sheet stack 14. Here the press means 30 also serves for the centering of the penetration needles 20. The pressing means 30 also serves to compress the sheet stack 14 and to prevent the upper sheets being torn upon extraction of the penetration needle 20. As shown in FIG. 3D, a small passage 52 remains after the extraction of the penetration needle 20, as is also the case with the embodiment of FIGS. 1 and 2.

The arrow 22 of FIGS. 3A and 3C indicates that the penetration needles 20 are rotated in the clockwise direction during driving-in and the counter-clockwise direction during extraction. It is however also conceivable not to provide any rotation of the penetration needles 20 (for example, during the drive-in movement of FIG. 3, i.e. to set the rotary speed equal to zero).

In contrast to the embodiments shown in FIGS. 1 to 3, the penetration needles 20 could be arranged in the support element 10 or 10' in place of in the carrier beam 18. In such an arrangement, the driving-in movement would take place from the bottom upwardly or from the inner side of the sheet stack 14 towards its outer side. During this, the adhesive can be supplied either as shown in FIGS. 1 and 2 at the outwardly disposed side or, as shown in FIG. 3, at the inwardly disposed side of the sheet stack 14.

The FIGS. 4A to D show various forms of the penetration needles 20. In some embodiments, the needles 20 can also have a drilling function and can thus be formed as drilling needles.

The penetration needle 20' of FIG. 4A is provided with a thread-like groove 21. The individual turns of the thread can be somewhat undercut in order to form larger pockets for the reception of the adhesive. This type of needle design is shown in the embodiment of FIGS. 2A to D and FIGS. 3A to D. As a result of the rotation of the penetration needles 20 in the clockwise direction during the penetration movement, as illustrated in FIG. 2A, the thread-like formation causes the needles 20 to pull themselves through the sheet stack 14 in the manner of a thread cutter. During this movement, the adhesive which is located in the grooves will be scraped off as a result of the relative sliding between the surface of the needles 20 and the walls of the so formed passages in the sheet stack. The adhesive will be pressed or massaged between the individual sheets. This pressing-in of the adhesive is also continued during the extraction of the needles with rotation in the opposite direction as illustrated in FIG. 2C.

In the embodiment of FIGS. 3A to D the adhesive is transferred onto the paper sheets in the same way. That is, the adhesive is transferred on extraction of the needles during the rotation in the counter-clockwise direction in accordance with FIG. 3C, i.e. the adhesive or glue is scraped from the grooves and turns of the needle 20 into the passages in the sheet stack 14. In this embodiment (as well as in the other embodiments) front end 54 of the needles has a pointed shape, so that the paper here is displaced more to the side by the needle 20 rather than being drilled out. This has the advantage, that after the removal of the needles 20 the paper, provided with adhesive, moves back again, at least in part. The passages thus are smaller than the outer diameter of the needles 20.

In accordance with FIG. 4B the needles 20' are provided with a type of twist screw thread 21*a* in similar manner to a drill, i.e. with a greater pitch. This type of tool is also suitable for use in the method of FIGS. 2 and 3. This also applies for the embodiment in accordance with FIG. 4C where the needles 20' have a direct screw thread 21*b* and where the tip 54' is not only pointed, but is also formed in the manner of a chipboard screw in order to achieve the broadening of the passage in the sheet stack 14 to the core diameter of the screw without generating large quantities of drilling flour. This embodiment is shown to a larger scale in FIG. 5, and when used in an embodiment in accordance with FIG. 3 the material flow, i.e. the flow of adhesive from the screw onto the bore of the sheet stack 14 is ideal. During the through driving of the needles 20 no material dust arises and the sheet material is displaced without pronounced chip forming arising.

In accordance with FIG. 4D, the needles 20' are provided with a type of cutting screw thread 21C. This embodiment can also be used in the method of FIGS. 2 and 3 respectively.

It will be recognized that it is possible to selectively vary the rotational speeds and the speed of advance, i.e. the drive-in speed or the extraction speed of the needles, so that it is matched to the thread pitch. The result is that the corresponding thread shape is generated in the sheet stack 14 and the scraping action during the transfer of the adhesive onto the sheet stack is large. It is also possible to select the speed of advance, i.e. the drive-in speed or the speed of extraction differently. In this manner no clean thread is cut in the sheet stack 14. The slip-page which then arises and a certain stagnation effect also leads to a favorable transfer of the adhesive to the sheet stack. In this way a type of drilling dust can arise which leads, in admixture with the adhesive, to a high quality connection between the individual sheets of the sheet stack 14 after the removal of the penetration needles 20.

In FIG. 6 the finished adhesive bond is illustrated. This Figure shows how the small passage 52 which remains after the removal of the penetration needles 20 is reduced in diameter relative to the diameter of the bore 36 and the support beam 10, the diameter of which is only fractionally larger than the diameter of the needles 20. It can also be seen that the adhesive is not only present as a thin film along the inner wall of the passage 52, but rather that the adhesive zone 55 is present with a certain radial depth. The material displaced sideways during the driving-in of the needles 52 has moved back into the passage 52, i.e. the originally larger passage has become smaller.

Figure 7A:
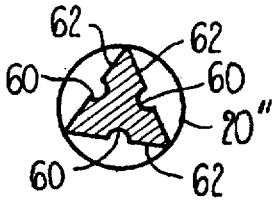
FIGS. 7A, B, C, D, E and F show sketches of various variants of an embodiment for the execution of the adhesive connection between a plurality of sheets laid on top of one another.
Figure 7B:
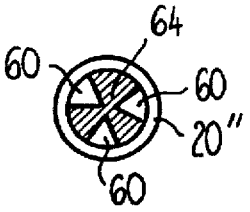
Figure 7C:
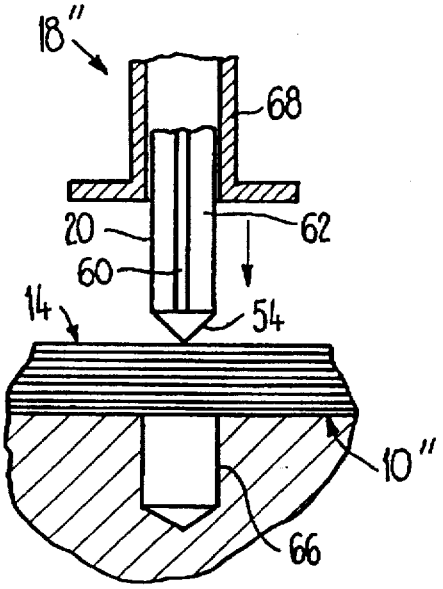
Figure 7D:
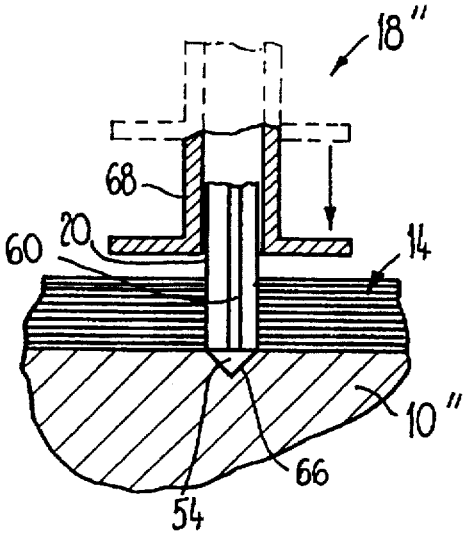

Finally, FIGS. 7A to F show further embodiments of penetration needles which can be used. In accordance with FIG. 7A the penetration needle 20" has in cross-section the shape of an equilateral triangle with longitudinal grooves 60 receiving adhesive in the respective side surfaces 62 of the triangle. In FIG. 7B the drive-in needle 20" has a circular cross-section with three sector-like longitudinal grooves 60, with a core region 64 of the needles 20" being retained. FIG. 7C shows how, with the aid of the needles 20" of FIG. 7B, the sheet stack 14 is penetrated and the penetration needles are receiving in a corresponding receiving chamber 66 of the support 10" In accordance with FIG. 7D this receiving chamber 66 is solely replaced by a recess which accommodates the tip of the penetration needle. The arrangement can be so effected that after the perforation of the paper sheets the needle holder, or a displaceable sleeve 68 of the needle holder 18, is pressed further downwardly and thereby pressing a controlled quantity of adhesive into the sheet stack.

Figure 7E:
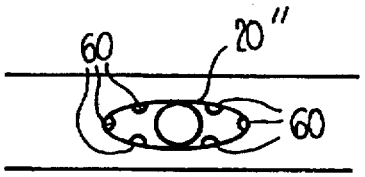

In accordance with FIG. 7E, the penetration needle 20 is knife-like, with a flat oval form in cross-section. The needle 20 here is also provided with longitudinal grooves or channels 60, which serve to receive adhesive. Since the adhesive is provided in these grooves or channels 60, it is not so easily scraped off from the tool during the linear penetration movement of the penetration needles 20" (which here takes place without a superimposed rotary movement). Rather, the displaced paper material is urged into the grooves 60 and an approximately uniform distribution of the adhesive onto the individual sheets of the paper stack 14 takes place.

Figure 7F:
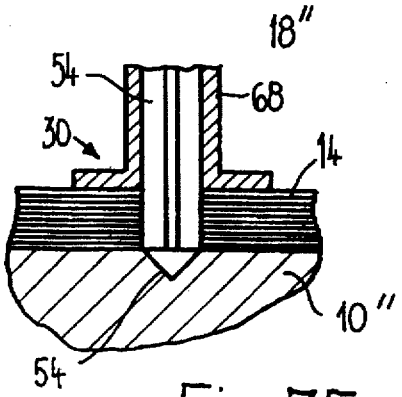

Finally, FIG. 7F shows how the holder 18" or the displacement sleeve 68 of the holder 18" can simultaneously effect the function of a pressing means 30, to prevent tearing the paper sheets on extraction of the penetration needles 20.

The described adhesive bond is made, along a line which, as can be seen from FIG. 1, corresponds in prefolded sheets with their fold line 16. Alternatively, the bond can be made along the line about which the finished end product (for example, a magazine, a brochure or an issue) is later folded with non-prefolded sheets.

The most diverse adhesives available in commerce can be used as an adhesive, such as for example cold glue. Adhesives can also be used which require a follow-up treatment, for example a thermal treatment after their introduction into the passages 52.

What is claimed is:

1. Method for connecting the sheets of a multi-sheet printed product, in which the sheets are adhesively connected together point-wise by an adhesive introduced into at least one perforation formed in the sheets, comprising the steps of:

forming at least one perforation extending through the sheets by using an elongated perforation tool having an outer surface and a pointed forward end by first driving the perforation tool at a penetration speed through the sheets and subsequently extracting the perforation tool at an extraction speed;

applying an adhesive directly from outside of the perforation tool to the outer surface of the perforation tool either prior to the penetration by the perforation tool into the sheets or after the penetration by the perforation tool but prior to the extraction of the perforation tool, so that the adhesive applied to the perforation tool is transferred onto the sheets over the entire length of the at least one perforation during the driving or extracting of the perforation tool through the sheets; and providing at least one recess on the outer surface of the perforation tool for receiving the adhesive applied to the outer surface of the perforation tool, the at least one recess being open towards the outside of the perforation tool and extending rearwardly from the pointed forward end of the perforation tool over at least part of the length of the perforation tool.

2. A method in accordance with claim 1, wherein the step of applying an adhesive further comprises rotating the perforation tool during at least one of the driving and extracting movements.

3. A method in accordance with claim 1, wherein the step of extracting the perforation tool comprises a screwing out movement of the perforation tool to transfer the adhesive onto the sheets.

4. A method in accordance with claim 1; wherein the perforation tool comprises a plurality of perforation tools arranged in at least one row on a common support beam and the step of forming the at least one perforation comprises driving and extracting the plurality of perforation tools to form a plurality of perforations.

5. A method in accordance with claim 1 wherein the step of providing at least one recess comprises providing at least one thread-like groove to transfer the adhesive.

6. A method in accordance with claim 5, wherein the perforation tool is rotated at a rotation speed during at least one of the penetrating and extracting movements, and further comprising the step of matching the rotation speed of the perforation tool and at least one of the penetration speed and the extraction speed of the perforation tool to a pitch of said thread-like groove.

7. A method in accordance with claim 5, wherein the perforation tool is rotated at a rotation speed during at least one of the penetration and extraction movements, and further comprising the step of selecting the rotation speed of the perforation tool and at least one of the penetration speed and the extraction speed of the perforation tool so that they are not matched to a pitch of said at least one thread-like groove.

8. A method in accordance with claim 1 further comprising the step of selecting the penetration speed of said perforation tool differently from the extraction speed thereof.

9. A method in accordance with claim 2, wherein the perforation tool has a speed of rotation during the step of driving and a speed of rotation during the step extracting and further comprising the step selecting the speed of rotation of the perforation tool different during the driving movement from the speed of rotation during the extraction movement.

10. A method in accordance with claim 9, wherein the step of selecting comprises selecting one of the said speeds of rotation such that it is zero.

11. A method in accordance with claim 9 further comprising the step of varying at least one of said speeds of rotation during penetration and extraction of said perforation tool.

12. A method in accordance with claim 4 wherein the plurality of perforation tools have tips and further comprising the step of supporting the sheets during the adhesive bonding procedure on a support which has recesses or openings aligned with the perforation tools to receive the tips of these tools.

13. A method in accordance with claim 1 further comprising the step of arranging the sheets to lie on top of one another such that said sheets are bonded together point-wise along a line which coincides with a folded edge of the multi-sheet printed product.

14. A method in accordance with claim 1 further comprising the step of subjecting the adhesive to a treatment after its introduction into the at least one perforation.

15. A method in accordance with claim 14, wherein said step of treating comprises treating said adhesive with a thermal treatment.

16. A method in accordance with claim 1, wherein said driving and extracting steps comprise moving said perforation tool with a linear non-rotational movement.

17. An apparatus for connecting the sheets of a multi-sheet product with an adhesive introduced into at least one perforation formed in the sheets, comprising:

at least one elongated perforation tool having a pointed forward end for forming at least one perforation in the sheets during a penetration and a subsequent extraction movement, the perforation tool having an outer surface and a closed tip;

an adhesive applying tool applying adhesive directly from the outside of the at least one perforation tool to the outer surface of the at least one perforation tool;

at least one recess formed on the outer surface of the at least one perforation tool for receiving the adhesive applied to the outer surface of at least one the perforation tool, the at least one recess being open towards the outside of the at least one perforation tool and extending rearwardly from the pointed forward end of the at least one perforation tool over at least a part of the length of the at least one perforation tool;

means for advancing the at least one perforation tool through the penetration and extraction movements; and the adhesive applying tool applying adhesive either prior to the penetration by the at least one perforation tool or after the penetration of the perforation tool but prior to the extraction of the at least one perforation tool to transfer the adhesive to the walls of the at least one perforation during the penetration or extraction movement of the at least one perforation tool through the sheets.

18. Apparatus in accordance with claim 17, wherein said at least one recess is formed by one of a channel and a groove.

19. Apparatus in accordance with claim 17, wherein a rotary drive is provided for the perforation tool.

20. Apparatus in accordance with claim 19, wherein said rotary drive is reversible.

21. Apparatus in accordance with claim 17, further comprising a pressing means which presses against the stack of sheets during at least one of the penetration and extraction movement of the at least one perforation tool.

22. Apparatus in accordance with claim 17, wherein the at least one perforation tool comprises a plurality of perforation tool, and further comprising a support for the sheets provided with recesses or openings aligned with the perforation tools.

23. Apparatus in accordance with claim 17, wherein the adhesive applying tool is located directly above the sheets in a penetration region of the at least one perforation tool for applying adhesive to the outer surface of the at least one perforation tool.

24. Apparatus in accordance with claim 17, wherein the applying tool is moveable into a penetration region of the at least one perforation tool for applying the adhesive to the outer surface of the at least one perforation tool.

25. Apparatus in accordance with claim 17, wherein the at least one perforation tool comprises a plurality of perforation tools and wherein the adhesive applying tool comprises a plurality of adhesive outlet nozzles corresponding to the number of the perforation tools.

26. Apparatus in accordance with claim 25, wherein said adhesive applying tool is movable towards and away from the perforation tools.

27. Apparatus in accordance with claim 26, further comprising a synchronizing means which synchronizes the toward and away movement of the adhesive applying tool with the movement of the perforation tools, with the adhesive applying tool being arranged directly adjacent the perforation tools prior to driving them into the stack of sheets.

28. Apparatus in accordance with claim 17, wherein the adhesive applying tool is arranged beneath the sheets which lie on top of one another for applying the adhesive to the outer surface of the at least one perforation tool which penetrates through the sheets prior to the extraction of the at least one perforation tool.

29. Apparatus in accordance with claim 28, wherein said adhesive applying tool comprises at least one hollow chamber in or beneath a support which supports the sheets.

30. Apparatus in accordance with claim 17, wherein the at least one recess is defined by at least one groove of a screw thread shape.

31. Apparatus in accordance with claim 30, wherein the at least one groove has a thread-like shape which forms one of an undercut, a twist screw thread form, a direct screw thread form, and a cutting screw thread form.

32. Apparatus in accordance with claim 31, wherein the at least one perforation tool comprises a self-cutting threaded screw.

33. Apparatus in accordance with claim 17, wherein the at least one perforation tool is formed as a drilling needle and has a pointed end.

34. Apparatus in accordance with claim 17, wherein the at least one perforation tool is formed as a penetration needle and has a cross-section approximately in the form of a equilateral triangle, with at least one longitudinal channel forming the at least one adhesive receiving recess.

35. Apparatus in accordance with claim 17, wherein the at least one perforation tool is formed as a penetration needle and has a cross-section approximately of circular cross-section with a at least one sector-like longitudinal groove which serves as the at least one adhesive receiving recess.

36. Apparatus in accordance with claim 17, wherein the at least one perforation tool is formed as a penetration needle and has an elongated, knife-like, shallow oval shape in cross-section, with longitudinal grooves defining the at least one adhesive receiving recess being distributed around the outer periphery of the at least one perforation tool.

37. Apparatus in accordance with claim 17, wherein said at least one perforation tool comprises a plurality of perforation tools which are arranged in at least one row on a common carrying beam.

38. Apparatus in accordance with claim 37, wherein said beam is moveable towards the sheets.

39. Apparatus in accordance with claim 17, wherein said at least one perforation tool is arranged in a support.

40. Apparatus in accordance with claim 17, further comprising a support for the sheets which is movable towards the at least one perforation tool.

41. Apparatus in accordance with claim 40, wherein said support rotates about an axis which extends parallel to its longitudinal axis, and the at least one perforation tool is co-movable with the support.

* * * * *